US006085448A

United States Patent [19]

Gale et al.

[11] Patent Number: 6,085,448

[45] Date of Patent: Jul. 11, 2000

[54] MECHANICAL RETENTION SYSTEM FOR GROUND ENGAGING TOOLS

[75] Inventors: Preston L. Gale, Mackinaw; Richard E. Livesay; Joseph W. Puckett, both of Peoria; Christopher J. Stickling, Dunlap, all of Ill.

[73] Assignee: Caterpillar Inc., Peoria, Ill.

[21] Appl. No.: 09/243,779

[22] Filed: Feb. 3, 1999

Related U.S. Application Data

[63] Continuation-in-part of application No. 08/961,304, Oct. 30, 1997, abandoned.

[51] Int. Cl.[7] ..... E02F 9/28; B25G 3/00; F16D 1/00

[52] U.S. Cl. ..... 37/458; 37/452; 37/455; 403/376

[58] Field of Search ..... 37/452, 453, 455, 37/456, 457, 458, 459; 403/376, 380

[56] References Cited

U.S. PATENT DOCUMENTS

| | | | |
|---|---|---|---|
| 5,465,512 | 11/1995 | Livesay et al. | 37/457 |
| 5,719,070 | 2/1998 | Ruvang | 37/459 |
| 5,724,756 | 3/1998 | Gale | 37/458 |
| 5,782,019 | 7/1998 | Launder et al. | 37/446 |
| 5,806,215 | 9/1998 | Matthews | 37/452 |

*Primary Examiner*—Eileen Dunn Lillis
*Assistant Examiner*—Gary S. Hartmann
*Attorney, Agent, or Firm*—O. Gordon Pence; John W. Morrison

[57] ABSTRACT

A mechanical retention system is disclosed for detachably retaining a ground engaging tool onto an earthworking implement. The retention system uses an elongated steel retainer, which has a convolute spring portion between opposite the end portions of the retainer to allow the retainer to be compressible in one direction in order to be mounted through a retainer opening in the tool into a retainer pocket in the mounting portion of the implement.

19 Claims, 12 Drawing Sheets

MECHANICAL RETENTION SYSTEM FOR GROUND ENGAGING TOOLS

RELATION TO OTHER PATENT APPLICATION

The present application is a continuation-in-part of co-pending patent application Ser. No. 08/961,304, filed Oct. 30, 1997 with the same title as above.

TECHNICAL FIELD

The present invention relates generally to ground engaging tools for earthworking implements and the like and, more particularly, to a mechanical retention system for detachably retaining a replaceable tool onto such implements.

BACKGROUND ART

Earthworking implements, such as buckets, blades, rippers, bowls and the like, used on earthworking machines, such as loaders, excavators, tractors, scrapers and the like, commonly employ ground engaging tools that engage the earth being worked or materials being excavated or loaded. Because of the loading forces and highly abrasive materials encountered, ground engaging tools wear out rapidly and need to be replaced in order to protect the parent material of the implement and to keep the implement working at peak efficiency. Because of such frequent replacement, it is desirable to be able to quickly and easily remove the worn tool and replace it with a new one. Many types of retention devices, such as pins and the like, have been used in the past to retain the tool onto the tool mounting portion of the implement. Some typical examples of retention devices used for retaining bucket teeth are disclosed in U.S. Pat. No. 5,068,986 issued Dec. 3, 1991 to Larren F. Jones for Excavating Tooth Point Particularly Suited for Large Dragline Buckets; U.S. Pat. No. 5,272,824 issued Dec. 28, 1993 to Erwin D. Cornelius for Tooth Assembly with Leaf Spring Retainer; and U.S. Pat. No. 5,423,138 issued Jun. 13, 1995 to Richard E. Livesay, et al for Tip to Adapter Interface.

Many such prior retention devices perform satisfactorily, but are either complex and expensive, or require special tools or the large exertion of effort to remove and replace the retainers. Other retainers may simply fail during use, resulting in the loss of the tool from the implement.

The present invention is directed to overcoming one or more of the problems encountered in the use of prior art tools and retention devices.

DISCLOSURE OF THE INVENTION

In accordance with one aspect of the present invention, a mechanical retention system is provided for detachably retaining a replaceable tool onto an earthworking implement. The retention system includes a generally rectangular retainer opening through the sidewall of the tool that has a pair of opposing end surfaces and a pair of opposing side surfaces. One of the pair of opposing side surfaces defines a first abutment and the end surfaces are disposed a predetermined distance apart to provide the opening with a predetermined length. A retainer pocket is formed in the side surface of a mounting portion of the implement and is positionable in registry with the retainer opening. The pocket defines a second abutment oriented in an opposing relation to the first abutment. An elongated spring retainer is positionable between the abutments to retain the tool onto the implement. The retainer has a pair of opposite side surfaces, a pair of opposite end portions, an integral convolute spring portion and a thickness sufficient to define a first elevational portion and a second elevational portion. Each end portion has a flange extending therefrom within the confines of the first elevational portion a sufficient distance to provide the retainer with a predetermined length between the flanges that is greater than the predetermined length of the retainer opening. The spring portion is adapted to allow the forcible compression of the retainer to a length sufficient to permit the insertion of the flanges through the retainer opening wherein the first elevational portion is disposed in the retainer pocket where one of the sides of the retainer is in an abutting relation with the second abutment and the second elevational portion is positioned in the retainer opening where the other of the sides thereof is in an abutting relation with the first abutment and each of the flanges are disposed in abutting relation to the interior surface of the sidewall of the tool.

BEST MODE FOR CARRYING OUT THE INVENTION

Figure 1:
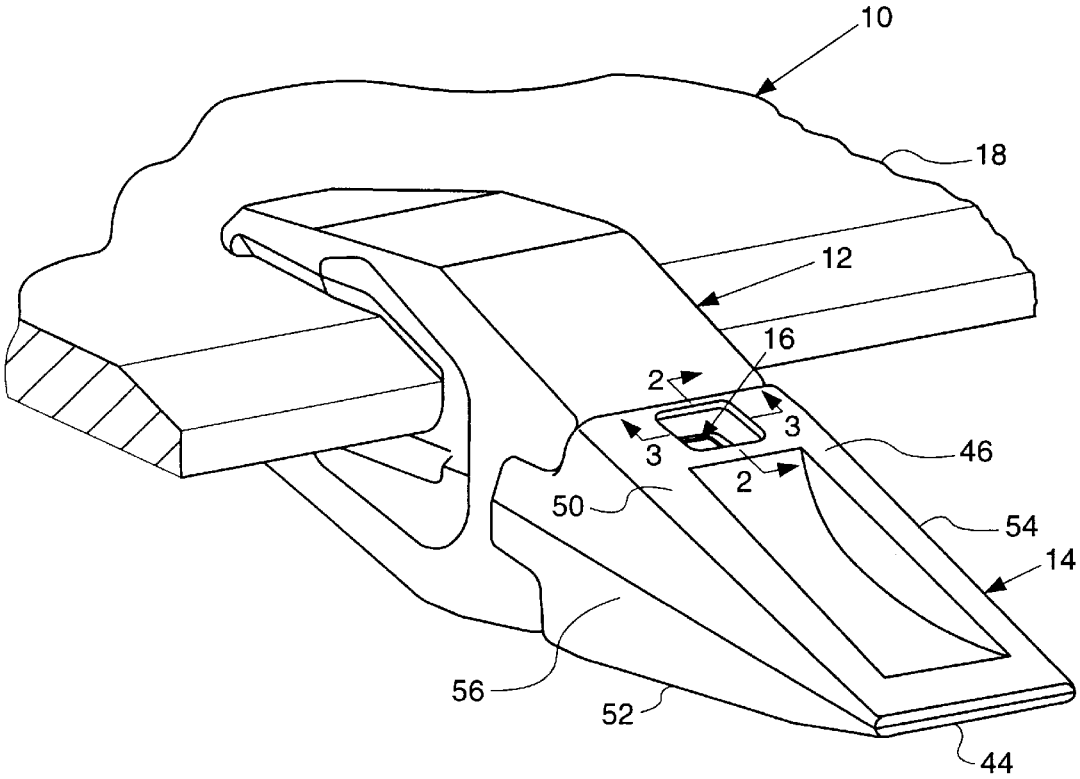
FIG. 1 is a fragmentary perspective view of an implement with a tool mounted onto a mounting portion thereof and being retained by a mechanical retention system embodying the principles of the present invention.

Referring to the drawings and more particularly to FIGS. 1–5, an earthworking implement 10, which in the exemplary embodiment depicted in FIG. 1 is a bucket, has a ground engaging tool mounting portion or adapter 12 upon which is carried a replaceable ground engaging tool 14, which in this case is a tooth. The tool or tooth 14 is detachably retained on the adapter 12 by a mechanical retention system 16 to be more fully described below. It should be appreciated that the exemplary embodiments depicted in the drawings and described herein are merely for illustrative purposes, as it is contemplated that the present invention be used for other closely related ground engaging tool and implement applications. Examples of related implements include buckets and shovels, bulldozer and motor grader blades, rippers, scraper bowls and the like. Examples of tools for such implements include tips, cutting edges and cutting edge protectors, corner and side protectors, tooth couplers and adapters and the like. Such implements, mounting members and tools therefor are all well known in the art and all of such uses are intended to be covered by the present invention even though they have not been specifically shown or described herein, as those skilled in the art are readily able to incorporate the teachings of the present invention into such other applications.

Figure 2:
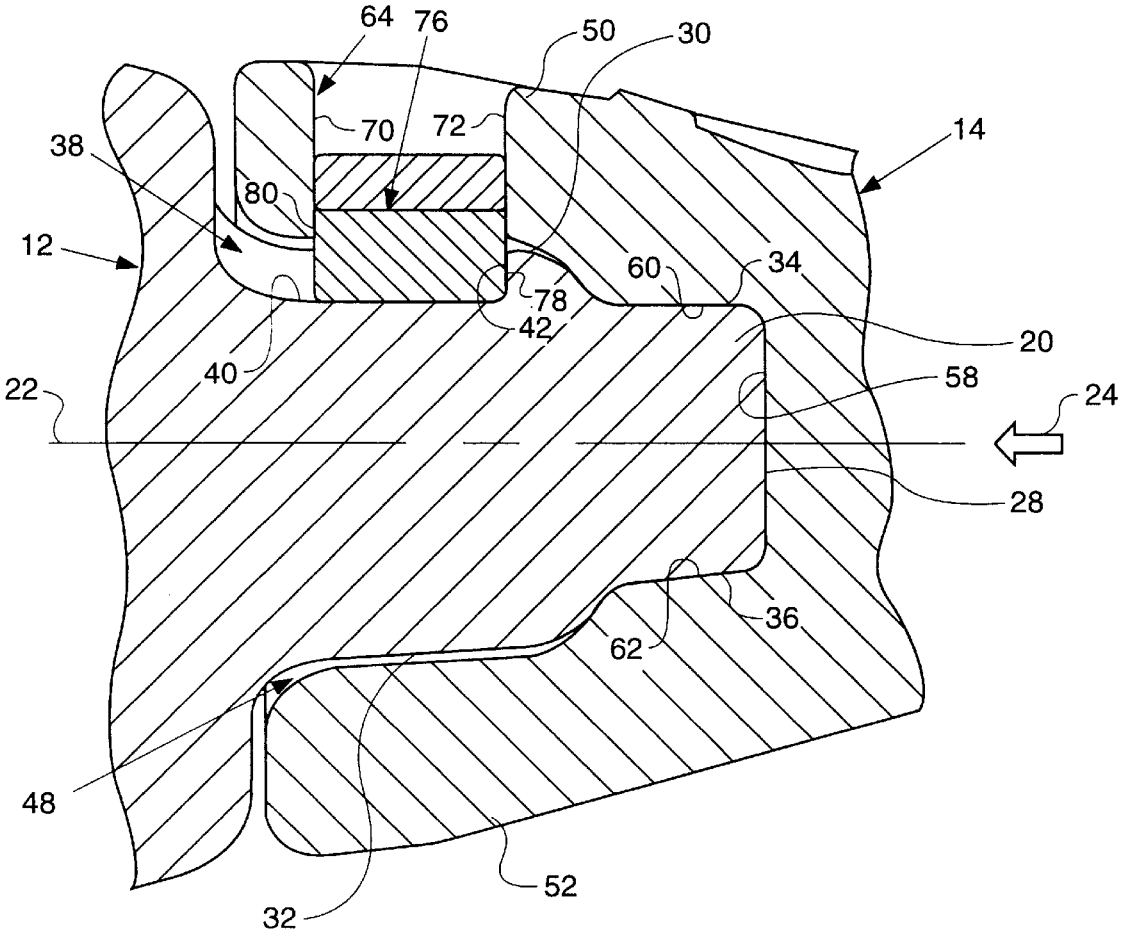
FIG. 2 is a fragmentary cross-sectional view of the retention system taken generally along line 2—2 of FIG. 1.

In the embodiment depicted in FIGS. 1–5, the implement or bucket 10 has a cutting edge 18. The cutting edge 18, as customary in the art, carries a plurality of adapters, one of which is shown at 12. The adapter 12 is secured in the present embodiment to the cutting edge 18 by welding and has a forward tooth mounting portion or nose 20, as best shown in FIG. 2. The nose 20 extends along an axis 22, which is generally oriented along the normal direction of working forces exerted on the tooth 14 when the tooth 14 is in working engagement with the ground, as depicted by arrow 24, and has a blunt abutment surface 28 which is oriented in a direction normal to the normal working force direction 24 for receiving loading forces from the tooth 14. The nose 20 also has top and bottom side surfaces 30,32 extending rearwardly from the abutment surface 28. Each top and bottom surface 30,32 is preferably provided with one of a pair of planar surfaces 34,36, adjacent, but normal to the abutment surface 28 for receiving working forces which are oblique to the normal working force direction 24. The top side surface 30 is provided with a retainer pocket 38 having a bottom 40 and a side abutment 42. The side abutment 42 faces in the same direction as the direction of the normal direction 24 of the working forces and extends in a direction normal to the normal working force direction 24.

The tooth 14 (FIG. 1) is preferably tapered with a sharp forward ground engaging edge 44 for penetrating the ground and a rearward mounting end portion 46. The mounting end portion 46 has a nose receiving socket 48 (FIG. 2) defined by top and bottom sidewalls 50,52, left and right hand sidewalls 54,56 and an abutment surface 58 at the bottom of the socket 48 which mates with abutment surface 28 of the adapter 12 for transferring loads into the adapter in the normal direction of working forces 24. The top and bottom sidewalls 50,52 have a stepped interior configuration with each having a planar surface 60,62 which mates with a respective one of the planar surfaces 34,36 of the nose 20 of the adapter 12 for transferring oblique forces acting on the tooth 14 into the nose 20 of the adapter 12.

The tooth 14 also has a generally rectangular retainer opening 64 disposed through one of the sidewalls of the mounting end portion 46, which, in the embodiment shown, is in top sidewall 50. The retainer opening 64 has a pair of opposing end surfaces 66,68 and a pair of opposing side surfaces 70,72. When the tooth 14 is mounted onto the adapter, the retainer pocket 38 of the adapter 12 is disposed in registry with the retainer opening 64. The side surface 70 which faces in a direction opposite to the normal working force direction 24 defines a first abutment 70 that is disposed in a spaced opposing relation to the side abutment or second abutment 42. The end surfaces 66,68 of opening 64 are disposed a predetermined distance apart to provide the opening with a predetermined length "$L_1$".

Figure 3:
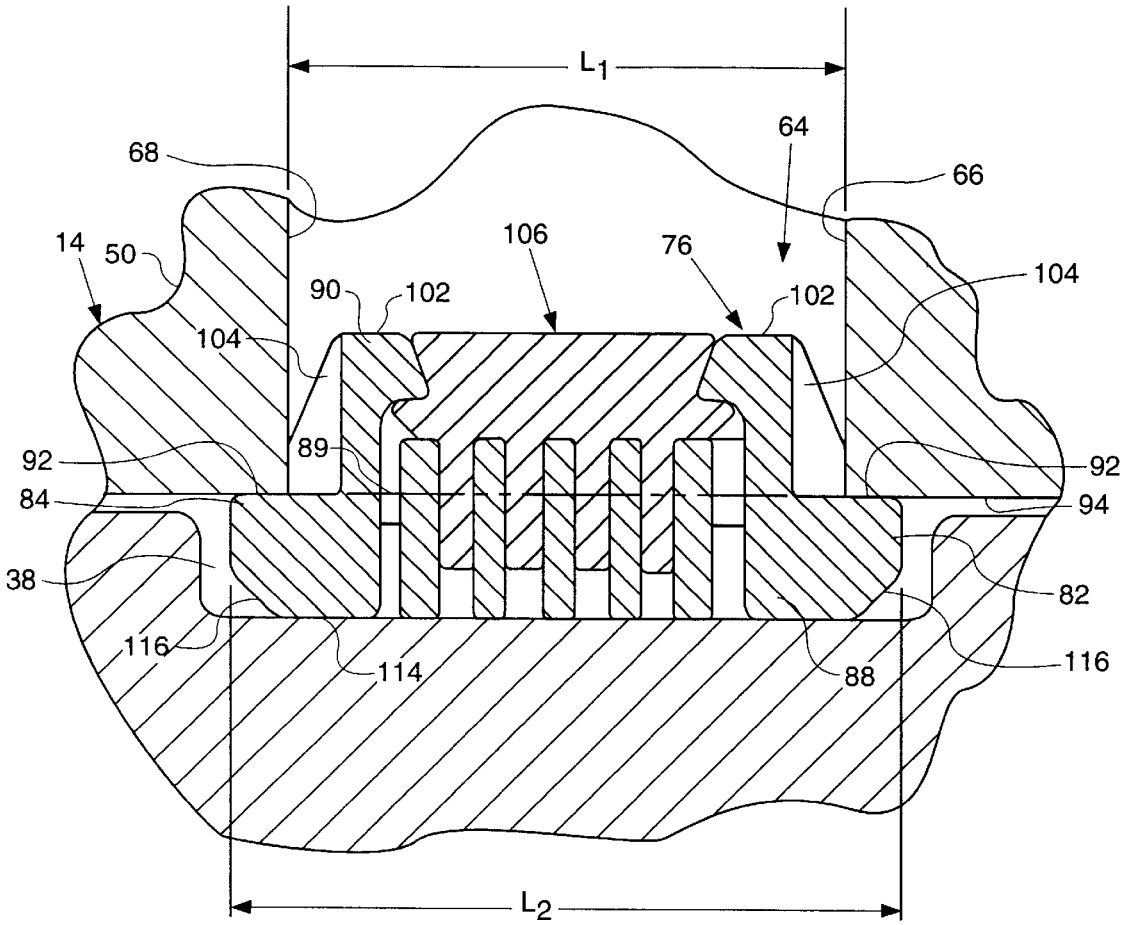
FIG. 3 is a fragmentary cross-sectional view of the retention system taken generally along line 3—3 of FIG. 1.
Figure 4:
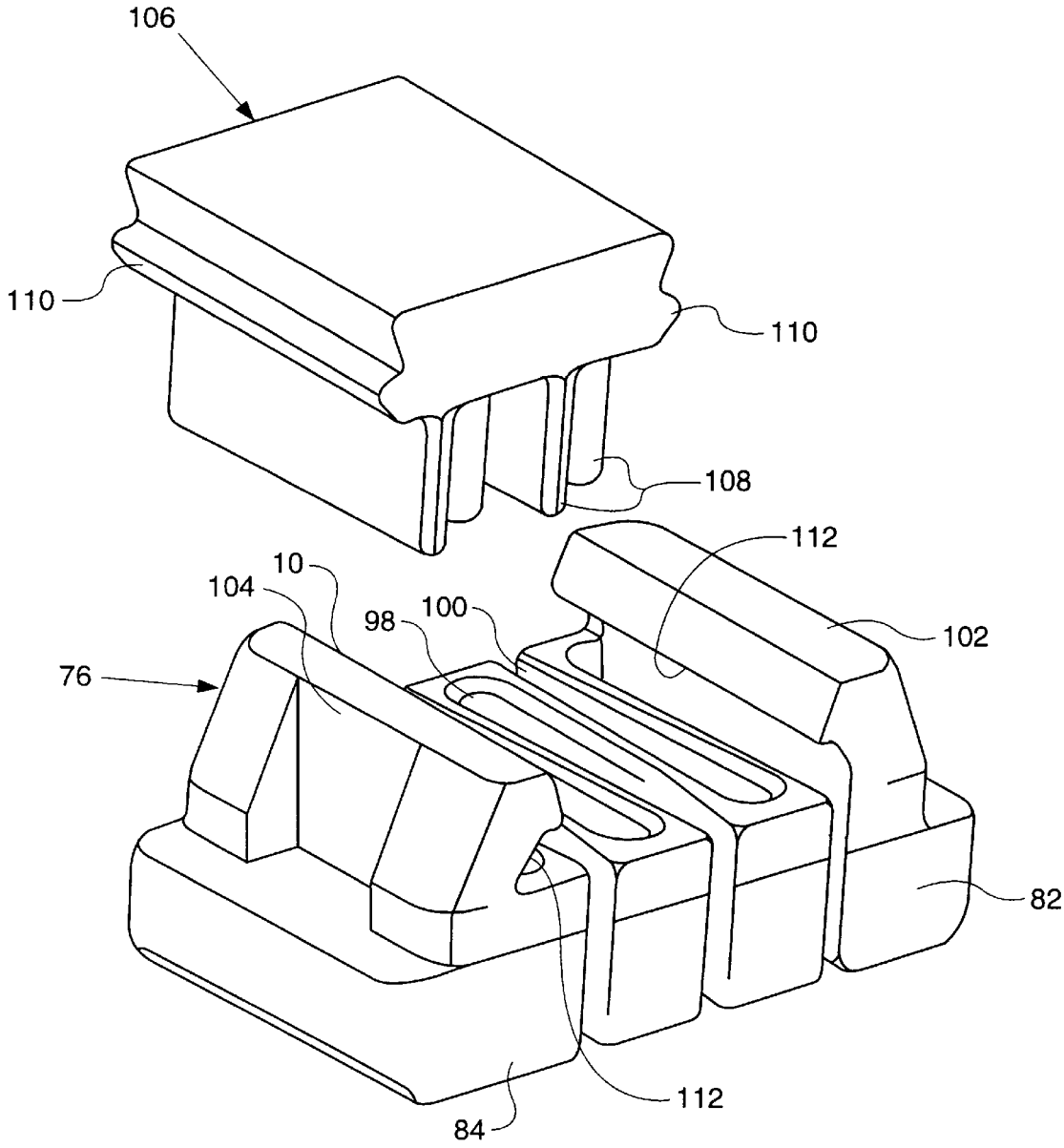
FIG. 4 is an exploded perspective view of the retainer and cover illustrated in FIGS. 2 and 3.

The mechanical retention system 16 includes an elongated spring retainer 76 having a longitudinal axis 77. The retainer 76 is preferably an integral casting constructed of spring steel or other suitable metal. Retainer 76 includes a pair of opposites sides 78,80, a pair of opposite end portions 82,84 and an integral convolute spring portion 86 between the end portions 82,84. The retainer 76 is of a thickness sufficient to define a first elevational portion 88 disposed below a phantom line 89 in FIG. 3 and a second elevational portion 90 disposed above line 89. Each end portion 82,84 has a flange 92 extending therefrom within the confines of the first elevational portion a sufficient distance to provide the retainer 76 with a predetermined length $L_2$ between the flanges 92 that is greater than the predetermined length $L_1$ of the retainer opening 64. The spring portion 86 is adapted to allow the forcible compression of the retainer 76 from its longer non-compressed length $L_2$ to a shorter compressed length sufficient equal to or less than the retainer opening length $L_1$ to permit the insertion of the flanges through the retainer opening 64. When the retainer 76 is in its mounted position, as best shown in FIG. 3, the flanges 92 extend beyond the retainer opening 64 and are positioned to engage an interior surface 94 of the top sidewall 50 to lock the retainer 76 in place in its tooth retaining position wherein the first elevational portion 88 of the retainer 76 is disposed in the retainer pocket 38 where one side 78 (FIG. 2) of the retainer 76 is in an abutting relation with the second abutment 42 and the second elevational portion 90 is positioned in the retainer opening 64 where the other side 80 thereof is in an abutting relation with the first abutment 70.

Figure 5:
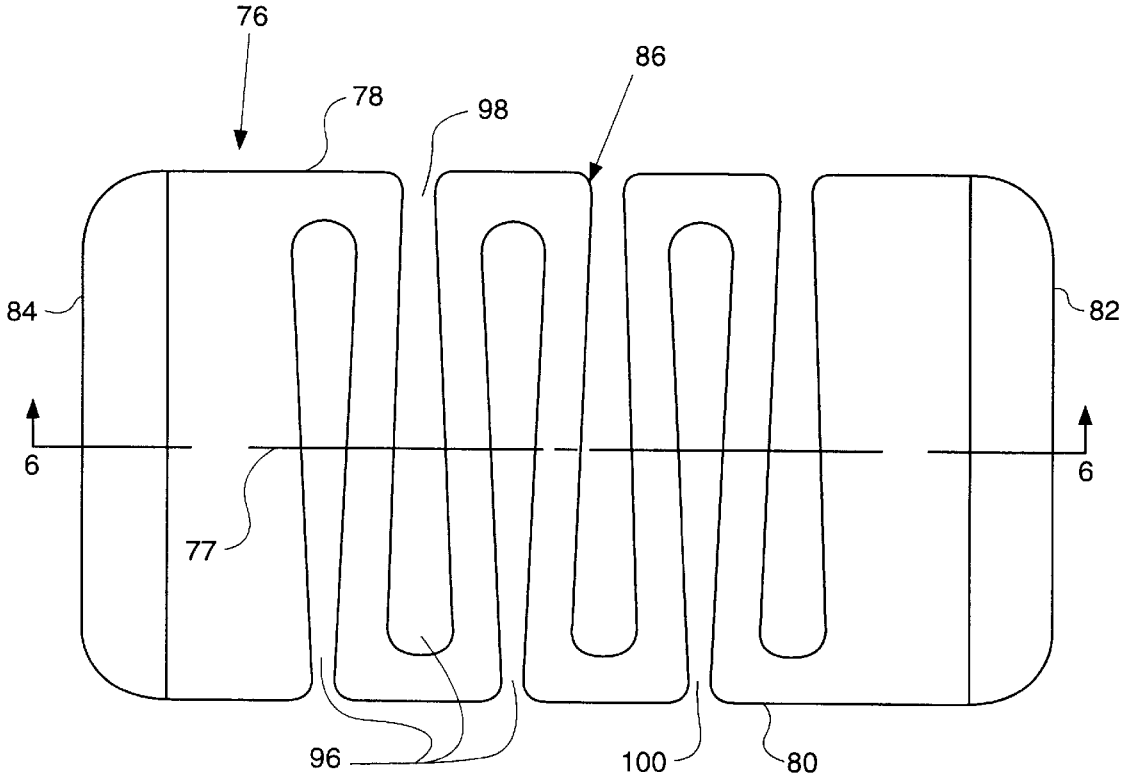
FIG. 5 is a bottom plan view of the retainer illustrated in FIG. 4.

As best shown in FIG. 5, the convolute spring portion 86 of the retainer 76 is formed by a plurality of interleaved slots 96 cut into the retainer, with a first set of the slots 98 extending from one of the sides 78 toward the other side 80 and with a second set of the slots 100 being disposed between adjacent ones of the first set of slots 98 and extending from the other of the sides 80 toward the one of the sides 78.

Each of the end portions 82,84 of the retainer 76 has an upstanding boss 102 thereon that project above the spring portion 86. Each of the bosses 102 have a tool slot 104 formed therein that opens toward its adjacent end surface 66, 68 respectively, of the opening 64, which are adapted to receive a pry tool (not shown) for compressing the retainer 76 in order to permit the removal of the retainer. The retainer 76 has a bottom surface 114 and a chamfered corner 116 between each of the end portions 82,84 and the bottom surface 114 to facilitate in the compression of the retainer 76 as it is being placed into the retainer pocket 38.

The retention system 16 also preferably includes cover 106, which is adapted for receipt in and sized to close the retainer opening 64 above the retainer 76. The cover 106 may be constructed entirely of an elastomeric material, such as rubber or plastic, and is provided with a plurality of fingers 108 that are adapted to be received into respective ones of the interleaved slots 98,100 of the retainer 76 to prevent debris from filling the slots during use. A tongue 110 is provided on opposite ends of the cover, which are adapted to snap into a groove 112 formed on the inwardly facing side of each of the bosses 102 for retaining the cover to the retainer 76.

Figure 9:
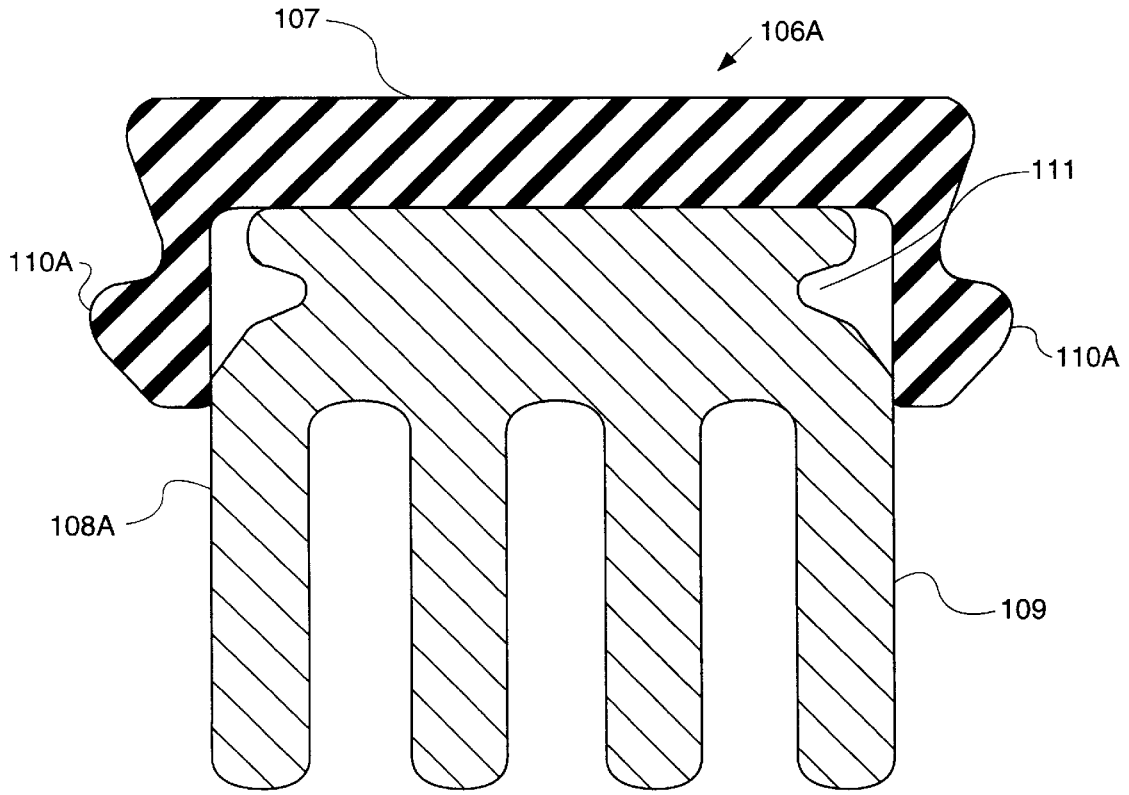
FIG. 9 is a cross-sectional view of another embodiment of the cover for the retainer.

Alternatively, as shown in FIG. 9, a cover 106A may have a composite construction, where an upper cap portion 107 and tongues 110A are made of plastic or rubber, but a lower finger portion 109 having fingers 108A is constructed from metal. Lower portion 109 also includes a pry groove 111 on its opposite end Referring now to FIGS. 12 and 13, there is shown an alternative mechanical retention system 16B which includes the retainer 76, a cover 106B, and a separate cap 107B. The retainer 76 is substantially identical to the retainer 76 described above. The cover 106B is a single piece metal component having a number of fingers 108B defined thereon. The fingers 108B are configured to be received by a respective interleaved slot 98,100 of the retainer 76. Preferably, the metal of the fingers 108B is stainless steel. The stainless steel construction of the fingers 108B reduces potential corrosion between the fingers 108B and the respective interleaved slots 98,100 of the retainer 76 which receive the fingers 108B. The reduction of corrosion between the fingers 108B and the respective interleaved slots 98,100 reduces the likelihood that the cover 106B will bind to the retainer 76 in corrosive environments.

Placing rigid metal fingers 108B within the interleaved slots 98,100 also prevents compression of the convolute spring portion 86 of the retainer 76 in the general direction of arrows 85 and 87. By preventing the compression of the convolute spring portion 86, the flanges 92 of the retainer 76 are maintained in contact with the respective interior surfaces 94 of the tooth 14 (see FIG. 3) thereby ensuring that the tooth 14 is retained in the adapter 12 by the retainer 76 when the retainer 76 is positioned in the tooth retaining position.

Figure 13:
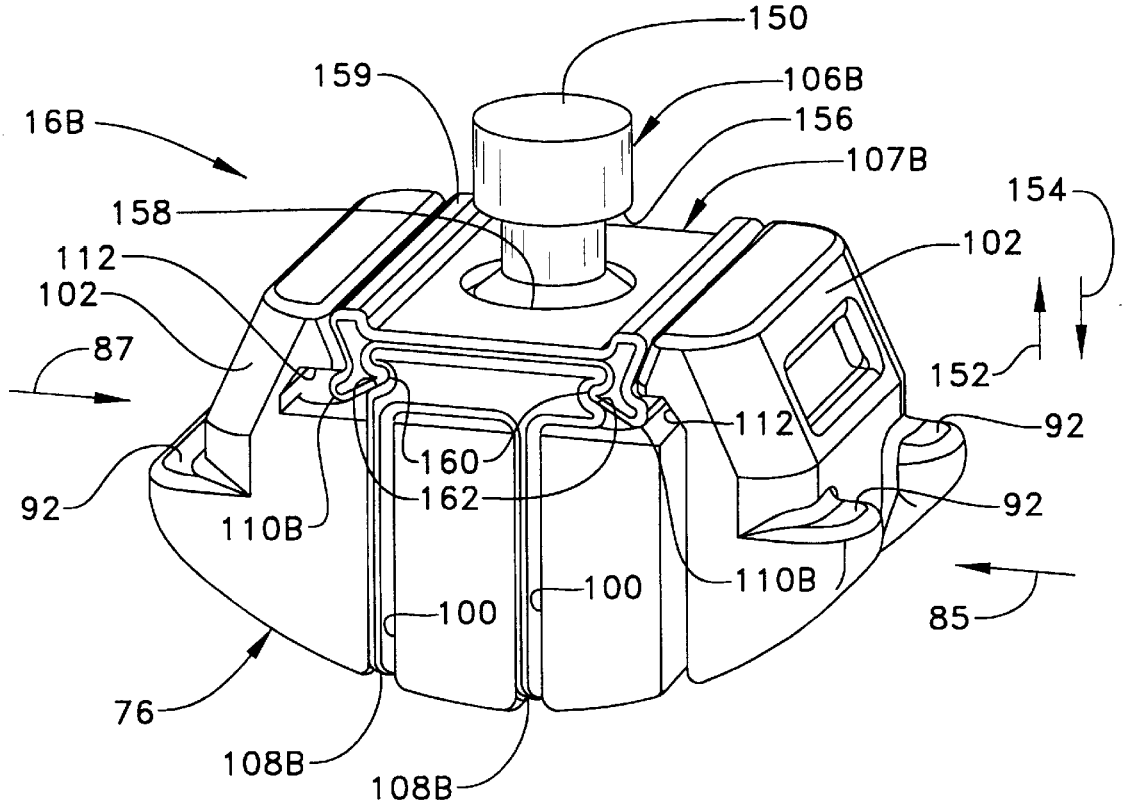
FIG. 13 is a view similar to FIG. 12, but showing the alternate embodiment mechanical retention system in the assembled state.

The cover 106B further has a knob portion 150 defined thereon. The knob portion 150 extends upwardly from the cover 106B in the general direction of arrow 152 and has a prying surface 156 defined thereon. It should be appreciated that a pry tool, such a screwdriver, can be urged against the prying surface 156 so as to urge the cover 106B in the general direction of arrow 152. By urging the cover 106B in the general direction of arrow 152, the cover 106B can be extracted from the retainer 76 when the alternate mechanical retention system 16B is assembled, as shown in FIG. 13. It should further be appreciated that the knob portion 150 is positioned within the retainer opening 64 (not shown) when the retainer 76 is positioned in the tooth retaining position thereby reducing wear on the knob portion 150 as the implement 10 is used during a work operation.

Figure 12:
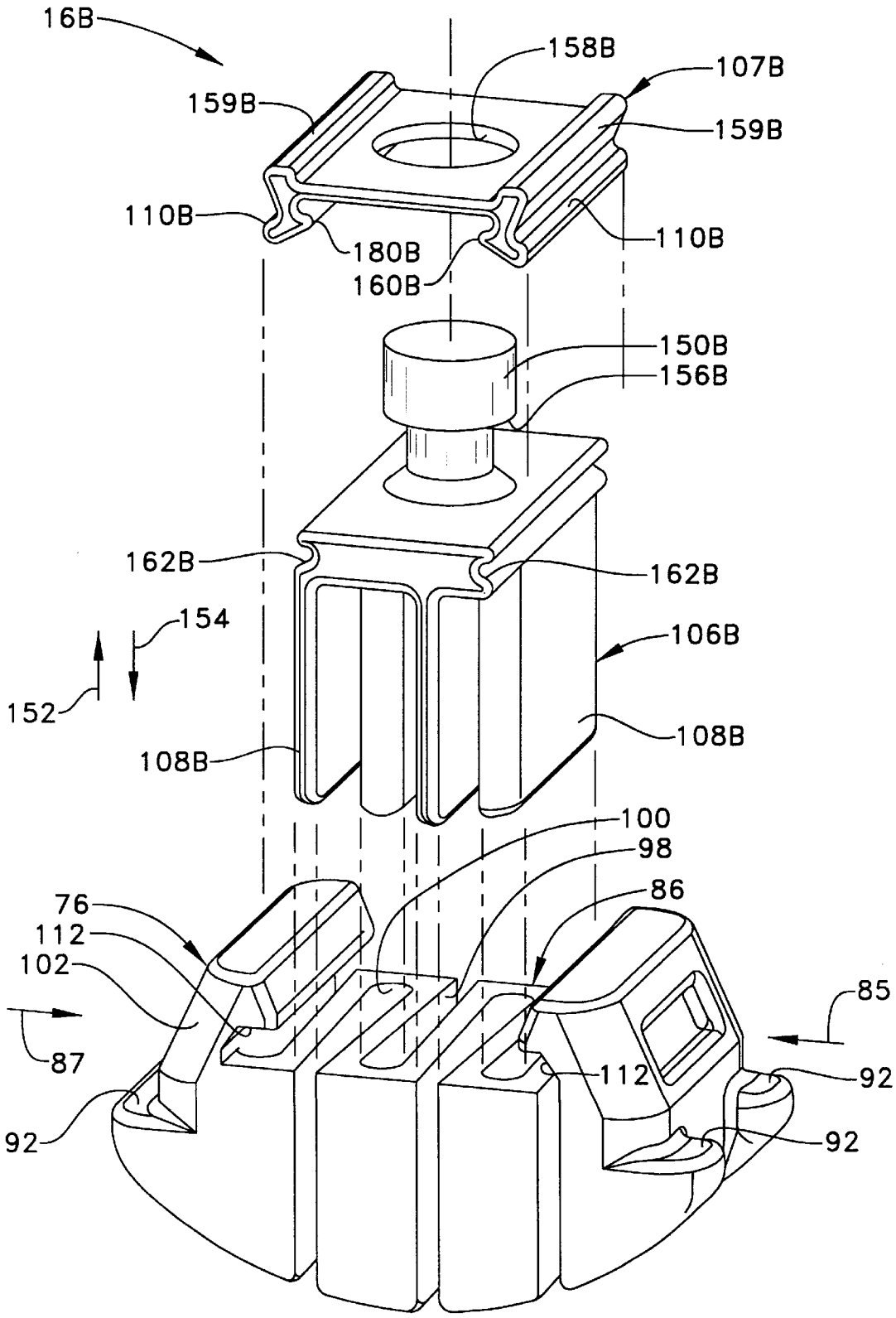
FIG. 12 is an exploded perspective view of an alternate embodiment of the mechanical retention system.

The cap 107B of the alternate mechanical retention system 16B is separate from the cover 106B as shown in FIG. 12. The cap 107B is composed of a plastic material which can be compressed in the general direction of arrows 85 and 87. The cap 107B has a knob aperture 158 defined therethrough. The knob aperture 158 is operable to receive the knob portion 150 of the cover 106B when the alternate mechanical retention system 16B is assembled (as shown in FIG. 13).

The cap 107B further has a pair of shoulders 159 defined along the outer surfaces thereof. A tongue 110B is defined in each of the shoulders 159. The tongues 110B are operable to engage a respective groove 112 of the retainer 76 when the alternate mechanical retention system 16B is assembled. The cap 107B further has a pair of engagement fingers 160 defined thereon. The engagement fingers 160 are advantageously configured to engage pair of notches 162 defined in the cover 106B.

It should be appreciated that a force can be applied to the shoulders 159 in the general direction of arrows 85 and 87 to distort the plastic cap 107B. Distortion of the cap 107B (i) facilitates engagement and disengagement of the tongues 110B of the cap 107B with the groves 112 of the retainer 76 and (ii) facilitates engagement and disengagement of the engagement fingers 160 of the cap 107B with the notches 162 of the cover 106B.

To assemble the alternate mechanical retention system 16B, the retainer 76 is positioned in the tooth retaining position described above. The cap 107B is positioned such that the knob portion 150 of the cover 106B is received through the knob aperture 158 of the cap 107B. The cap 107B is then secured to the cover 106B. In particular, the engagement fingers 160 of the cap 107B are positioned within the respective engagement notch 162 defined in the cover 106B thereby securing the cap 107B to the cover 106B.

The cover 106B is then positioned within the retainer 76. In particular, the fingers 108B of the cover 106B are advanced in the general direction of arrow 154 into the respective interleaved slot 98,100 of the retainer 76. Placement of the fingers 108B in the respective interleaved slot 98,100 prevents compression of the convolute spring portion 86 of the retainer 76 in the general direction of arrows 85 and 87. Placement of the fingers 108B in the respective interleaved slot 98,100 further prevents dirt or other debris from becoming packed within the interleaved slots 98,100 as the implement 10 is used during a work operation.

As the fingers 108B of the cover 106B are advanced into the respective interleaved slots 98,100 of the retainer 76, the tongues 110B of the cap 107B are urged into the respective groove 112 of the of the retainer 76 thereby securing the cap 107B to the retainer 76. It should be appreciated that because the cap 107B spans the retainer opening 64 (shown in FIG. 3) above the cover 106B, securing the cap 107B to the retainer 76 secures the cover 106B to the retainer 76.

To disassemble the alternate mechanical retention system 16B, the cover 106B is removed from the retainer 76. In particular, the fingers 108B of the cover 106B are extracted from the respective interleaved slot 98,100 of the retainer 76. To facilitate extraction of the cover 106B, the pry tool is urged against the prying surface 156 of the knob portion 150 so as to advance the cover 106B in the general direction of arrow 152 with respect to the retainer 76. Advancing the cover 106B in the general direction of arrow 152 also advances the cap 107B in the general direction of arrow 152 so as to cause the tongues 110B of the cap 107B to disengage from respective groove 112 of the of the retainer 76. Disengaging the tongues 110B from the cap 107B detaches the cap 107B from the retainer 76. The retainer 76 is then removed from the tooth retaining position as described above.

Figure 6:
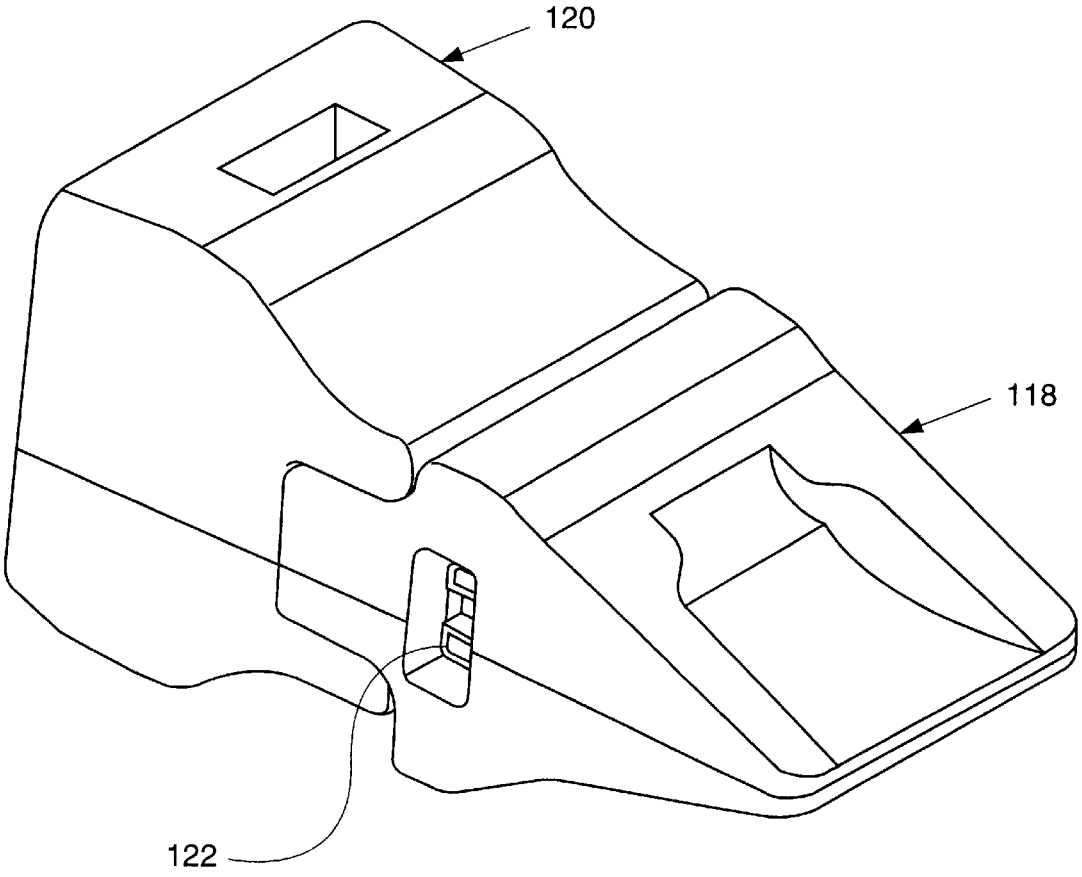
FIG. 6 a fragmentary perspective view similar to FIG. 1, but of another implement and tool being retained by the mechanical retention system.
Figure 7:
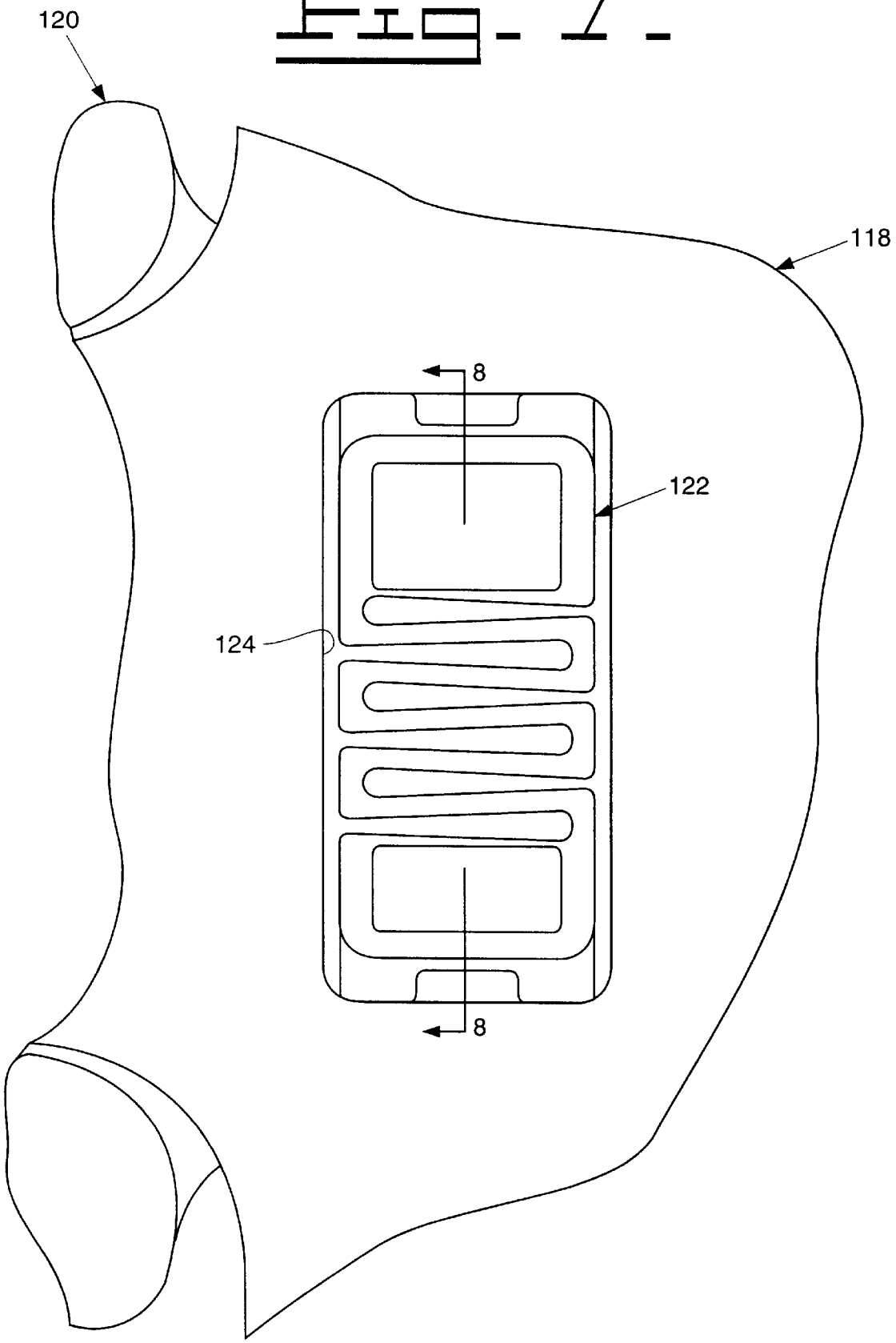
FIG. 7 is an enlarged side elevational view of retention system of FIG. 6.
Figure 8:
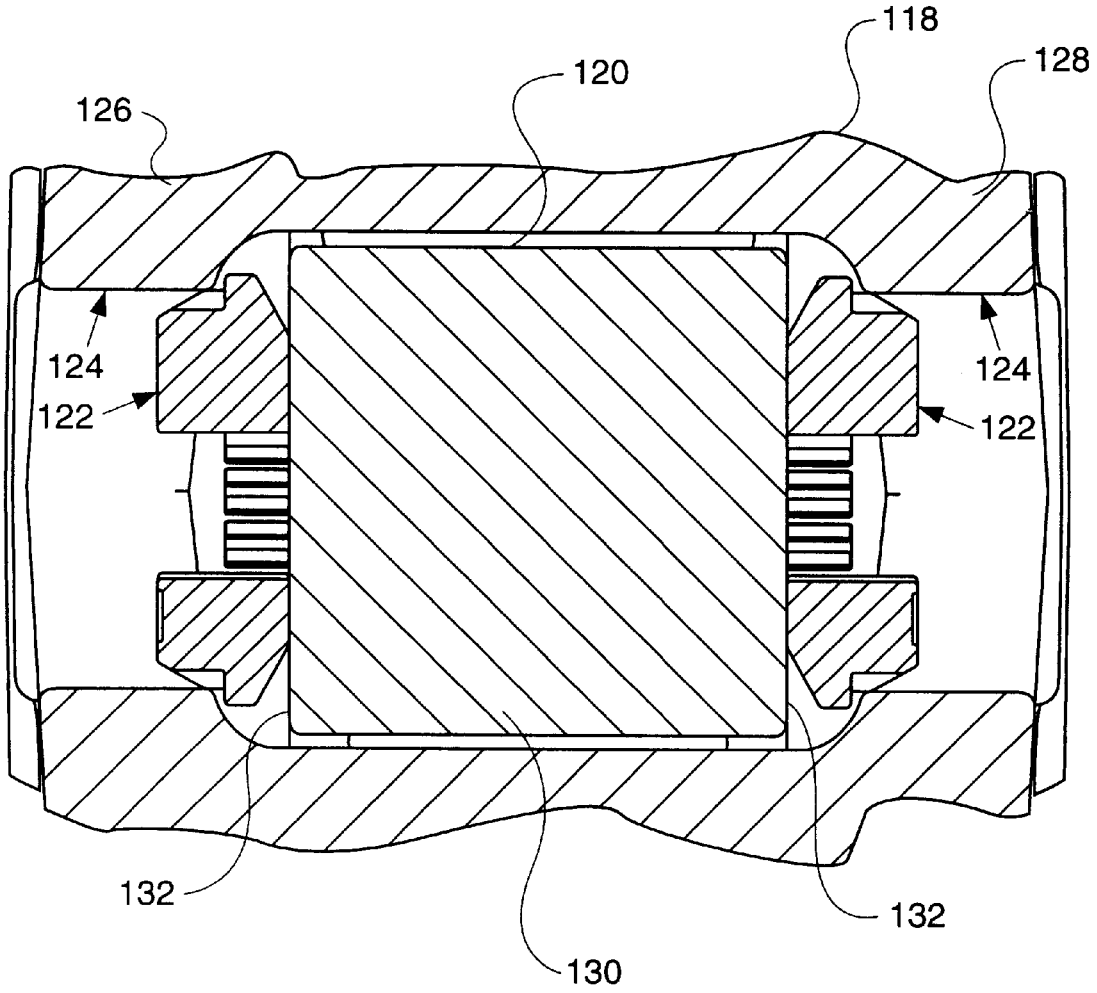
FIG. 8 is a cross-sectional view of the retainers taken along line 8—8 of FIG. 7.

In another embodiment of the present invention depicted in FIGS. 6–8, a larger tooth 118 is shown for use on a larger implement or bucket (not shown). In such applications, the larger tooth 118 is mounted to an intermediate member or coupler 120, instead of to an adapter. Also, it may be desirable to use two retainers 122, rather than the single retainer 76 depicted in the first embodiment. In such a case, the tooth 118 is provided with a pair of retainer openings 124 disposed through the opposite sidewalls 126,128 of the tooth. The coupler 120 has a nose portion 130 similar to nose portion of the adapter of the first embodiment, but has a pair of retainer pockets 132, one of such pockets being formed in a respective one of the side surfaces (not shown) of the nose portion 130. Each of such pockets 132 are positioned to be in registry with a respective one of the retainer openings 124 when the tooth 118 is mounted onto the coupler 120.

As is apparent from the drawings that the features of the retainers 122 and their relationships to the features of the retainer pockets 132 and retainer openings 124 are similar in nature to those features and relationships of the first embodiment and, therefore function in a similar manner, further description thereof is not deemed necessary and is omitted as any modifications as may be needed for its use in this embodiment will readily come to hand to those skilled in the art.

Figure 10:
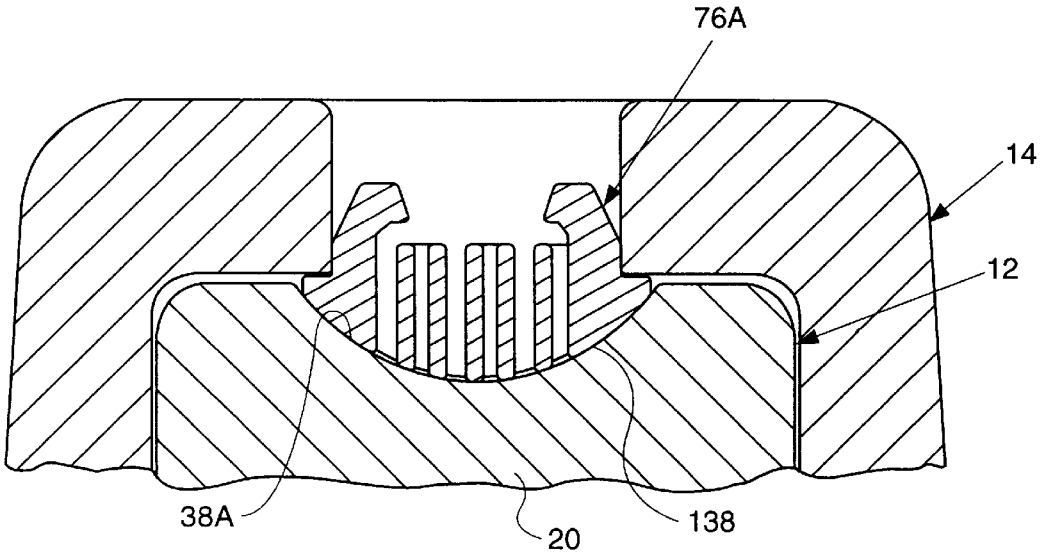
FIG. 10 is a fragmentary cross-sectional view similar to that of FIG. 3, but illustrating another embodiment of the retainer.
Figure 11:
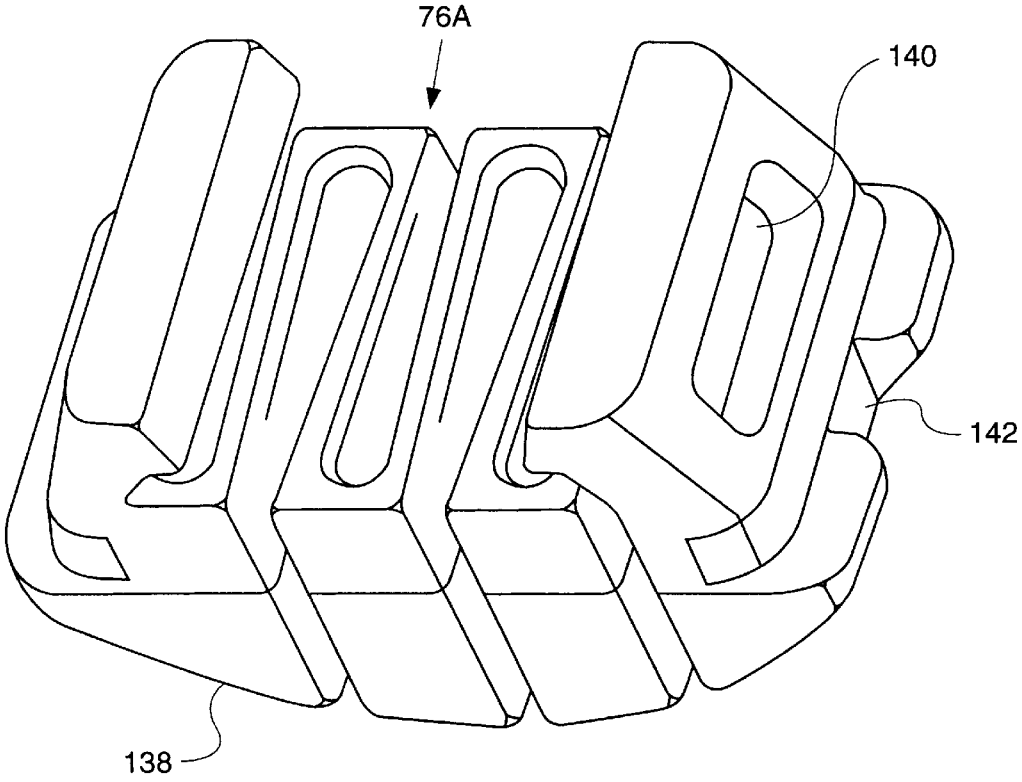
FIG. 11 is a perspective view of the retainer shown in FIG. 10.

Shown in FIGS. 10 and 11 is another configuration for the retainer. The main difference between the retainer 76 depicted in FIGS. 3–5 and retainer 76A depicted in FIGS. 10 and 11 is that retainer 76A is provided with a rounded bottom surface 138, rather than the flat bottom surface 114 that retainer 76 has. Also, the nose portion 20 of the adapter 12 is provided with a pocket 38A having an arcuate bottom 40A to match the rounded bottom surface 138 of retainer 76A. The rounded configuration of retainer 76A and bottom 40A is advantageous in providing the retainer 76A with a grater thickness, while minimizing the amount of material removed to provide the pocket 38A in adapter 12, thereby increasing the strength of the adapter 12. The retainer 76A is also provided with a pry pocket 140 and a pry slot 142 in each of the bosses 102A and flanges 92A, respectively, in place of the tool slots 104 shown in FIGS. 3 and 4.

Other applications of the present invention are also not shown or described, but will be readily apparent to those skilled in the art. For instance, the implement could as well be a ripper, with the mounting portion being a ripper shank and the tool being a ripper tip that is retained by the retainer of the present invention. Such retainer can also be used for retaining couplers to adapters, edge and corner protectors to buckets, blades and scraper bowls, as all of such applications are contemplated and are intended to fall within the scope of the appended claims hereto.

Industrial Applicability

The present mechanical retention system 16 affords many advantages of prior retention devices. For instance, the present retainer 76 is easily assembled into and removed from the retainer pocket 32 and retainer opening 64 without special tools and without the exertion of a large amount of effort. To install, the retainer 76 is placed into the opening and tapped down with the use of a hammer to compress the convolute spring portion 86. Once the flanges 92 pass the sides of the opening 64, the spring portion 86 will re-expand to its non-compressed state, where the flanges 92 will be seated against the interior surface 94 of the sidewall 50. The cover 106 is put in place to prevent the slots 96 from packing with dirt or other debris during use. To remove, the cover 106 is pried out with a blade screwdriver. Such screwdriver is then inserted into one of the tool slots 104 and leverage is applied to the retainer 76 to cause it to be compress and pried out of the retainer pocket 32 and retainer opening 64.

When using the alternate mechanical retention system 16B, shown in FIGS. 12 and 13, the retainer 76 is installed as described above. The cap 107B is then secured to the cover 106B by placing the engagement fingers 160 of the cap 107B within the notches 162 of the cover 106B. The cover 106B is then positioned within the retainer 76 by advancing the fingers 108B within the respective interleaved slots 98,100 in the general direction of arrow 152. As the fingers 108B advance, the tongues 110B of the cap 107B engage the respective groove 112 of the retainer 76 thereby securing the cap 107B and the cover 106B to the retainer 76. The metal fingers 108B of the cover 106B prevent compression of the convolute spring portion 86 of the retainer 76 in the general direction of arrows 85 and 87. The fingers 108B further prevent the interleaved slots 98,100 from packing with dirt or other debris during use. To remove the alternate mechanical retention system 16B, the cover 106B is then extracted from the retainer 76 by applying the pry tool against the prying surface 156 of the knob portion 150 so as to urge the cover 106B in the general direction of arrow 152. Extracting the cover 106B also detaches the cap 107B from the retainer 76 as the tongues 110B of the cap 107B are disengaged from the grooves 112 of the retainer 76. The retainer 76 is then removed as described above.

With the retainer 76 in place, the tooth 14 is prevented from coming off the adapter 12 because it acts as a stop between the first abutment 70 of the retainer opening 64 and the second abutment 42 of the retainer pocket 40. Because of the elevational separation between such abutments 70,42, the retainer 76 is loaded in shear therebetween. It should be noted that the tooth 14 is assembled onto the adapter 12 by movement in the working force direction 24 along axis 22 and can only be removed by movement in a direction opposite to direction 24. Because of this, such shear forces are only exerted on the opposite sides 78,80 of the retainer 76 and not in an end to end direction, as this would tend to compress the retainer 76. The retainer 76 is substantially rigid from side to side. End to end loading is prevented by the orientation of the longitudinal axis 77 of the retainer 76 in a direction transverse to the axis 22.

The operation of the retainers 122 in the embodiment shown in FIGS. 6–8 is essentially the same as that described for the first embodiment shown in FIGS. 1–5, except for the fact that two retainers are employed, rather than one, and such retainers 122 are located in a respective one of the sides of the tooth, instead of in the top side wall as in the first embodiment.

Other aspects and advantages of the present invention of this invention can be obtained through a study of the drawings, the disclosure and the appended claims.

What is claimed is:

1. A mechanical retention system for detachably retaining a replaceable tool onto an earthworking implement, said implement including a mounting portion adapted to receive said tool and having an abutment surface in force receiving contact with a mating abutment surface of said tool, said tool having a sidewall with an interior surface positionable along a corresponding side surface of said mounting portion, said retention system comprising;

a generally rectangular retainer opening through said sidewall of the tool, said opening having a pair of opposing end surfaces and a pair of opposing side surfaces, one of said pair of opposing side surfaces defining a first abutment and said end surfaces being disposed a predetermined distance apart to provide said opening with a predetermined length therebetween;

a retainer pocket formed in said side surface of said mounting portion and positionable in registry with said retainer opening, said pocket defining a second abutment oriented in an opposing relation to said first abutment; and an elongated spring retainer having a pair of opposite sides, a pair of opposite end portions, an integral convolute spring portion formed by a plurality of interleaved slots cut into said retainer, with a first set of said slots extending from one of said sides toward the other and with a second set of said slots being disposed between adjacent ones of said first set of slots and extending from the other of said sides to the one of said sides, and a thickness sufficient to define a first elevational portion and a second elevational portion, each end portion having a flange extending therefrom within the confines of said first elevational portion a sufficient distance to provide said retainer with a predetermined length between said flanges that is greater than said predetermined length of said retainer opening, said spring portion being adapted to allow the forcible compression of the retainer to a length sufficient to permit the insertion of said flanges through said retainer opening wherein said first elevational portion is disposed in said retainer pocket where one of said sides of said retainer is in an abutting relation with said second abutment and said second elevational portion is positioned in said retainer opening where the other of said sides thereof is in an abutting relation with said first abutment and each of said flanges are disposed in abutting relation to said interior surface of the sidewall of said tool.

2. The retention system of claim 1 wherein said implement is a bucket.

3. The retention system of claim 2 wherein said mounting member is an adapter and said tool is a bucket tooth.

4. The retention system of claim 2 wherein said implement includes a coupler and said mounting portion is on said coupler.

5. The retention system of claim 1 wherein said implement is a ripper and said mounting member is a ripper shank and said tool is a ripper tip.

6. The retention system of claim 1 wherein said retainer is constructed from spring steel.

7. The retention system of claim 1 each of said end portions of said retainer has a upstanding boss thereon, each of said bosses having a tool slot therein opening toward its adjacent end surface of the opening adapted to receive a pry tool for compressing the retainer in order to permit the removal of the retainer.

8. The retention system of claim 7, including a cover adapted for receipt in and sized to close said opening above said retainer.

9. The retention system of claim 8 wherein said cover is constructed of an elastomeric material and is provided with a plurality of fingers that are adapted to be received into respective ones of said interleaved slots of the retainer.

10. The retention system of claim 9 wherein each of the bosses has a groove and wherein said cover has opposing sides, each side having a tongue adapted to snap into a respective one of said grooves for retaining said cover within said retainer opening.

11. An elongated retainer for detachably retaining a replaceable tool onto an earthworking implement, said implement including a mounting portion adapted to receive said tool, said tool having a sidewall with a generally rectangular retainer opening of a predetermined length therethrough, said mounting portion having a retainer pocket formed in a side surface thereof positionable in registry with said retainer opening, said retainer comprising:

a pair of opposite side surfaces, a pair of opposite end portions, an integral convolute spring portion and a thickness sufficient to define a first elevational portion and a second elevational portion, each end portion having a flange extending therefrom within the confines of said first elevational portion a sufficient distance to provide said retainer with a predetermined length between said flanges that is greater than said predetermined length of said retainer opening, said spring portion being adapted to allow the forcible compression of the retainer to a shorter length sufficient to permit the insertion of said flanges through said retainer opening wherein:

said retainer opening has a pair of opposing side surfaces, one of said pair of opposing side surfaces defining a first abutment, said pocket defines a second abutment oriented in an opposing relation to said first abutment, said first elevational portion of said retainer is disposed in said retainer pocket where one of said sides of said retainer is in an abutting relation with said second abutment and said second elevational portion is positioned in said retainer opening where the other of said sides thereof is in an abutting relation with said first abutment, and said sidewall of the tool has an interior surface and each of said flanges are disposed in abutting relation to said interior surface of the sidewall of said tool.

12. The retainer of claim 11 wherein said retainer has a bottom surface and a chamfered corner between each of said end portions and the bottom surface.

13. A replaceable tool for an earthworking implement, said implement including a mounting portion adapted to receive said tool and having an abutment surface in force receiving contact with a mating abutment surface of said tool and a side surface having a retainer pocket adapted to receive an elongated spring retainer therein, said abutment surfaces being oriented generally normal to the normal direction of working forces exerted on said tool when in working engagement with the ground, and said spring retainer being compressible from a longer non-compressed length to a shorter compressed length between opposite flanges on each end portion of the retainer, said tool comprising:

a sidewall extending generally parallel to said direction of working forces and having an interior surface positionable along said side surface of said mounting portion of the implement;

a generally rectangular retainer opening through said sidewall of the tool, said opening having a pair of opposing end surfaces disposed along a longitudinal axis of said opening and a pair of opposing side surfaces, one of said pair of opposing side surfaces defining an abutment, said abutment facing in a direction generally opposite to said direction of working forces and said longitudinal axis being oriented in a direction perpendicular to said direction of working forces, and said end surfaces being disposed a predetermined distance apart to provide said opening with a predetermined length therebetween, said length being selected to receive the flanges of said spring retainer when in a compressed state, but prevent the escape of said retainer through said retainer opening when in a non-compressed state; and a cover having fingers that are adapted to be received into respective ones of said interleaved slots formed in said retainer.

14. The retention system of claim 13, wherein:

said cover is constructed of metal, and said metal fingers prevent compression of said convolute spring portion of said retainer when said fingers of said cover are received in said respective ones of said interleaved slots of said retainer.

15. The retention system of claim 14, wherein said metal is stainless steel.

16. The retention system of claim 14, wherein:

said cover has a knob portion defined thereon which is adapted to receive a pry tool, and said pry tool is applied to said knob portion to extract said cover from said retainer when said fingers of said cover are received in said respective ones of said interleaved slots of said retainer.

17. The retention system of claim 13, wherein (i) each of said end portions of said retainer has a upstanding boss thereon, and (ii) each of said bosses has a groove defined thereon, further comprising:

a cap (i) positioned over said cover when said fingers of said cover are received in said respective ones of said interleaved slots of said retainer and (ii) having opposing sides, each side having a tongue adapted to snap into a respective one of said grooves for retaining said cap over said cover so as to prevent movement of said cover relative to said retainer.

18. The retention system of claim 17, wherein said cap is composed of plastic.

19. The retention system of claim 17, wherein:

said cover has a knob portion defined thereon, said cap has an aperture defined therethrough, and said knob portion of said cover extends through said aperture of said cap when said cap is positioned over said cover.

* * * * *